US008562077B2

(12) United States Patent
Junker et al.

(10) Patent No.: US 8,562,077 B2
(45) Date of Patent: Oct. 22, 2013

(54) METHOD OF SETTING AN AUTOMATIC LEVEL CONTROL OF THE PLOW IN PLOWING OPERATIONS OF COAL MINING

(75) Inventors: Martin Junker, Rheinberg (DE); Armin Mozar, Hamm (DE)

(73) Assignee: RAG Aktiengesselscaft

( * ) Notice: Subject to any disclaimer, the term of this patent is extended or adjusted under 35 U.S.C. 154(b) by 222 days.

(21) Appl. No.: 13/140,012

(22) PCT Filed: Dec. 11, 2009

(86) PCT No.: PCT/EP2009/008863

§ 371 (c)(1),
(2), (4) Date: Jun. 15, 2011

(87) PCT Pub. No.: WO2010/075947

PCT Pub. Date: Jul. 8, 2010

(65) Prior Publication Data

US 2011/0248548 A1 Oct. 13, 2011

(30) Foreign Application Priority Data

Dec. 17, 2008 (DE) ..... 10 2008 062 381

(51) Int. Cl.
*E21D 23/03* (2006.01)
*E21C 35/24* (2006.01)

(52) U.S. Cl.
USPC ..... 299/1.6; 299/1.05

(58) Field of Classification Search
USPC ..... 299/1.05, 1.4, 1.6, 1.7, 1.8
See application file for complete search history.

(56) References Cited

U.S. PATENT DOCUMENTS

| | | | | |
|---|---|---|---|---|
| 4,887,935 | A * | 12/1989 | Koppers et al. | 299/1.7 |
| 5,228,751 | A * | 7/1993 | Ramsden, Jr. | 299/1.6 |
| 5,275,469 | A * | 1/1994 | Geuns et al. | 299/1.7 |
| 5,553,925 | A * | 9/1996 | Merten et al. | 299/1.1 |
| 8,376,467 | B2 * | 2/2013 | Junker et al. | 299/1.6 |

FOREIGN PATENT DOCUMENTS

| | | |
|---|---|---|
| DE | 102005005869 | 8/2006 |
| DE | 102007060170 | 7/2008 |

* cited by examiner

*Primary Examiner* — John Kreck
(74) *Attorney, Agent, or Firm* — Becker & Stachniak, P.C.; Robert Becker

(57) ABSTRACT

A method of setting an automatic level control of a plow in longwall mining operations. By means of a boom control mechanism, a control angle for setting motion of the plow, which is guided on a face conveyor, in an exploitation direction as a climbing, plunging or neutral motion is set. For each plow stroke, a cutting depth and the control angle, derived as a differential angle between inclinations of the face conveyor and of a top canopy of a shield support frame are determined. In a calculating unit, a face height change per plow stroke is calculated therefrom and a face height, as a projected height, is associated with each face position of the face conveyor. When a shield support frame that trails behind the plow in terms of a time delay reaches a respective face position, an actual height of the face is calculated and compared with the store projected height. For subsequent plow strokes, a height differential value between the projected and actual heights, determined for a respective face position, in the sense of a self-learning effect of the calculating unit when the control angle that is to be set to achieve a projected height of the face is prescribed, is taken into consideration.

23 Claims, 4 Drawing Sheets

METHOD OF SETTING AN AUTOMATIC LEVEL CONTROL OF THE PLOW IN PLOWING OPERATIONS OF COAL MINING

BACKGROUND OF THE INVENTION

The instant application should be granted the priority dates of Dec. 17, 2008, the filing date of the corresponding German patent application 10 2008 062 381.4, as well as Dec. 11, 2009, the filing date of the International patent application PCT/EP2009/008863.

The present invention relates to a method for setting an automatic level control of the plow in longwall mining operations, in underground coal mining, equipped with a hydraulic shield support and with a face conveyor that guides the plow at a plow guide mechanism formed thereon, whereby the position of the face conveyor, including the plow guided thereon, can be changed in the exploitation direction by means of a boom control mechanism that is supported on the shield support, and, by means of the boom control mechanism, a control angle for setting the motion of the plow in the exploitation direction as a climbing motion, a dropping motion or a neutral motion can be set.

One problem with the automatic level control of plow strokes, not only in the exploitation direction but also in the extraction direction of the plow, is, for example, on the one hand establishing an adequately large face opening in order to ensure the passage of the longwall equipment, for example without collision between plow and shield support frames as the plow travels past, and on the other hand keeping the yield of waste rock during the extraction work as low as possible, and consequently limiting the extraction work as much as possible to the seam layer without also picking up too much country rock. The deposit data concerning the seam thickness, footwall and roof levels, and the presence of saddles and/or depressions not only in the exploitation direction but also in the direction of travel of the plow, that are available prior to the extraction are too imprecise in order to be able to base an automatic control of the plowing and extraction work, including maintaining the required target face height, thereon.

The plow, which is equipped with chisels, has a fixed cutting height, depending upon the settings, and a relatively low cutting depth in the order of magnitude of about 60 mm, so that in contrast to a drum shearing, the height of cutting is in any case not variable during a plow stroke along the face front. In plow strokes, a control of the level of the plow via a control cylinder that is disposed between the face conveyor, has a fixed guide for the plow, and the shield support frame connected thereto, is provided as a so-called boom control. By means of the inclination of the face conveyor in the exploitation direction, which can be changed with the aid of the boom control, it is thus possible in addition to a level-neutral control, to impart to the face conveyor, and hence to the plow guided thereon, a dropping motion in the exploitation direction, even during the extraction travel, in which the plow, by the cutting of its base chisels into the footwall, tips or tilts, or also a climbing motion, in which the plow carries out an ascending extraction.

In connection with the extraction work using the plow, it should be possible to maintain a defined face opening, whereby this face opening is defined by the distance between the top canopy and the floor skid of the respective shield support frame in the region of its travel path. In particular where the footwall layer changes, or where the footwall is soft, having a lesser hardness than does the coal that is to be extracted, the main thing is to maintain the target height of the face by means of a permanent monitoring and adaptation of the level control of the plow.

If the footwall is harder than is the seam that is to be included in the extraction, a level control of the plow is also possible according to the known method of the boundary layer plow at the footwall, according to which the hard footwall assumes a certain guide function for the plow. Within the framework of a method known for this purpose, a sensor that is carried along at the level of the base chisel of the plow determines whether the base chisel is cutting in country rock, in other words in the footwall, or in the coal. First of all, from a hardware standpoint this method is vulnerable because the pertaining sensor, and the associated evaluation computer, are installed in an extremely harsh environment in or on the plow, and hence are subjected to corresponding stresses or defects that occur. Furthermore, the mobility of the plow requires a supply of power to the hardware by battery, and a data transmission via radio by means of a plurality of transponders disposed in the face, whereby the radio conditions, especially in low-roofed faces having high amounts of ferromagnetic components of the longwall equipment, are very difficult to control. Furthermore, this method also suffers from uncertainty with respect to its information-giving capability, and also entails corresponding time delays with regard to a possibly required regulation, because information that is at least somewhat reliable regarding the material cut by the plow can be obtained only after a number of plow strokes, i.e., after a shield support frame passes by a number of times, generally approximately five times.

It is therefore an object of the present invention to provide a method of the aforementioned type according to which, in all operating states of the longwall mining operation, an automation of the plow and extraction work is possible with respect to producing a defined face opening and/or the guidance of the longwall operation on the footwall layer.

SUMMARY OF THE INVENTION

The realization of this object, including advantageous embodiments and further developments of the invention, are derived from the content of the patent claims, which follow this description.

For this purpose, the present invention provides a method according to which, for each operation of the plow, the cutting depth and the control angle, which is derived as a differential angle between the inclination of the top canopy of the shield support frame and the inclination of the face conveyor in the exploitation direction, are determined and in a calculating unit the face height change per plow stroke is calculated therefrom such that, in the calculating unit, a face height, as a projected height, is associated with each face position of the face conveyor, wherein the face position corresponds to a plow stroke and wherein when the shield support frame that trails behind the plow in terms of a time delay reaches the respective face position, an actual height of the face is calculated on the basis of values detected by inclination sensors mounted on the shield support frame and is compared with the stored projected height, and wherein for subsequent plow strokes, a height differential value, between the projected height and the actual height, determined for the respective face position, in the sense of a self-learning effect of the calculating unit when the control angle for the plow that is to be set to achieve a projected height of the face is prescribed, is taken into consideration.

The inventive approach initially proceeds from the principle that as a function of the cutting depth of the plow, with each plow stroke, as a consequence of the set control angle, there results a change of the face height relative to the roof layer, which is assumed to be unchanged or uniform, and is fixed by the top canopy of each shield support frame that rests against the roof. A dropping of the plow set by the control angle therefore leads to an increase of the face height, and a climbing of the plow leads to a reduction of the face height. As a function of the control angle set at the boom control, it is thus possible, proceeding from an existing face height, to calculate the projected height of the face that is theoretically present after carrying out a plow stroke. As a consequence of the respectively existing operation conditions, the projected height is, however, not achieved in operational practice; rather, there results a lower actual height of the face, which is inventively determined when the shield support frame, which trails the plow in terms of a time delay, reaches the respective face position. The calculation of the actual height takes place on the basis of values detected by inclination sensors mounted on the shield support frame; however, the detection of the required values, and the calculating process itself, are not the subject matter of this invention.

Due to the deviation between the projected height and the actual height, with continuous use of a control angle set at the boom control a face would reach the target height of the face prescribed from the standpoint of mining only with a considerable time delay. To this extent, pursuant to the present invention the height differential value between the projected height and the actual height that is to be compensated for or adjusted for maintaining the target height of the face is already taken into account with the setting of the control angle in that, for example for achieving a specific height change with regard to maintaining the target height of the face via a control cycle comprised of a plurality of plow strokes, the control angle is made greater or smaller by an angular amount that corresponds to the determined height differential value, so that the respectively achieved actual height of the face corresponds to the desired height measure. As a consequence of the value detection and calculation of the height changes undertaken with each plow stroke, and the reactive assumption of the face height at the same face layer, a closed control loop is produced for the level control of the plow. Since over the continuing extraction the calculating unit constantly detects and monitors the conversion of the control angle into an actually occurring height alteration of the face, there results the utilization of a self learning effect by algorithms capable of self learning stored in the calculating unit, so that the control angles at the boom control that determine the control are respectively associated with actually achieved or achievable face heights.

Pursuant to one embodiment of the invention, on the basis of the control angle, which is to be set for achieving the target height of the face via a control cycle that includes a plurality of plow strokes, the target inclination of the face conveyor in the exploitation direction that results per plow stroke is predetermined in the calculating unit and is compared, for adjustment purposes, with the actual inclination of the face conveyor measured in each face position per plow stroke by means of inclination sensors mounted on the face conveyor, wherein if deviations are recognized optionally the control angle applicable for the next plow stroke is corrected. In so doing, the time delay that inherently results due to the checking of the actual height of the face at the shield support frame that trails the plow in terms of a time delay can be shortened, so that a correspondingly greater control loop can be set. The inclination of the face conveyor is, afterall, to be detected immediately after the conclusion of each control process with regard to the control angle, and can also already be utilized as a first correction value for the level control.

To the extent that pursuant to one embodiment of the invention the control angle prescribed by the calculating unit is established in relationship to the height differential value resulting per plow stroke, and in the calculating unit the limiting control angle of a reflection region determined due to the self-learning affect is stored, within which region respectively applicable, even different, control angles generate no height changes of the face, the influence of a footwall having a greater hardness than does the coal is therewith taken into account in the sense of a boundary layer recognition or a boundary layer guided plow. To the extent that despite a control angle set to dropping motion at the boom control, by means of the plow strokes no change of the face height occurs, it is prudent that the plow travels in contact with the footwall, with the hard footwall nonetheless preventing penetration of the plow upon a dropping motion. Only when the control angle exceeds a certain magnitude as an upper limit does the dropping motion become so great that the plow cuts into the footwall. On the other hand, as a lower limit such a control angle is retained at which the plow begins to carry out a climbing motion. The region disposed between the upper and lower limits of the control angle can be classified as a reflection region in which changes of the control angle have no influence upon the face height because the footwall does not permit a change of the height position of the plow, resulting in a boundary layer guided plowing, in other words a plowing at the footwall layer. Due to the self-learning effect, the calculating unit can identify the reflection region as a control.

In conformity therewith, for the situations where the region must leave the boundary layer guided plowing due to other operational influences, there is provided pursuant to a specific embodiment of the invention that with the setting of a control angle that is necessary for achieving a target height of the face and that effects a climbing motion or a dropping motion of the plow, the magnitude of the respectively applicable reflection region is taken into account, and the control angle is set to a value beyond the reflection region for bringing about the climbing motion or the dropping motion.

The self-learning effect of the plow with respect to the change of the actual height of the face resulting with a set control angle can be valid only as long as the base chisel position on the plow is not changed. A change of the base chisel position on the plow also leads to a change of the control situation of the plow, because a fixedly set control angle, for example with a base chisel of the plow set to a lower dropping tendency, effects a lower change in height than is the case when the base chisel is set to a greater dropping tendency. To this extent, it is provided pursuant to a specific embodiment of the invention that when the position of the base chisel of the plow changes with respect to a dropping tendency, a climbing tendency or a neutral motion of the plow, the calculating unit conveys information about the changed base chisel position. In conformity therewith, pursuant to a specific embodiment of the invention it is provided that in the calculating unit, a performance characteristic that matches the set base chisel position, and that is acquired from the past extraction, is called up for the relationship of control angle and height differential value relative to one another. If such a performance characteristic is not stored in the calculating unit, the control must first develop a performance characteristic that is matched to the new base chisel position during the following plow strokes.

With the aid of the inventive method, it is possible to automatically travel through saddles and depressions in that, pursuant to a specific embodiment of the invention, via the determination of the inclination of the top canopy of the shield support frame in the exploitation direction, the pattern or contour of depressions and/or saddles in the exploitation direction is determined, and in the calculating unit an adaptation of the path of cut of the plow parallel to the contour of the roof is set and the adapted target height of the face, which includes an additional height corresponding to the radius of the depression or saddle curvature, is established by an adaptation of the control angle of the plow level control. If the control recognizes a decrease of the radius of the depression or saddle curvature, the allowed for additional height is again cancelled.

The continuous detection of changes in the height of the shield support frame allows an inference of the respectively occurring convergence to the extent that at the shield support frame, during the plowing work, in other words while the shield support is stationary, a height loss is determined. Thus, it is provided pursuant to a specific embodiment of the invention that by means of a continuing detection of the height of the shield support frame, not only from plow stroke to plow stroke, but also at standstill of the longwall mining operation, the respectively occurring convergence is determined and continuously taken into account by an adaptation of the height differential value that is to be used for the setting of the control angle of the plow level control. A loss of height that has occurred must again be compensated for by an increase of the control angle to achieve or maintain the target face height, and hence by an increase of the projected or actual height established by the plowing work.

In this connection, it can also be provided that for standstill times of the longwall mining operation, a convergence that is to be expected is included in the determination of the height differential value. Thus, for example prior to the weekend, the face opening can intentionally increase by an increase of the control angle, and hence an increase of the height differential value, so that despite a convergence that occurs over the weekend, at the beginning of the week the target height of the face is available for the restarting of the longwall mining operation.

To the extent that in connection with operational standstills, for example raising of the floor occurs, which also leads to a reduction of the face height, such raisings of the floor lead to a change of the position of the face conveyor, even during its standstill, which is recognized by the control system; even during the standstill of the plow or conveying operation. Thus, pursuant to one specific embodiment of the invention, with a raising of the floor that has occurred during a standstill of the longwall mining operation, the change of the inclination of the face conveyor is detected during the standstill of the plow, and prior to beginning the plowing work the control angle required for achieving the target height of the face is recalculated.

Pursuant to one embodiment of the invention, a plurality of shield support frames and pertaining boom cylinders of the boom control are connected to form one group that can be controlled by means of a single group control mechanism.

Since each shield support frame has a different arrangement or installation tolerance with the arrangement of the inclination sensors mounted thereon, a completely parallel mechanical orientation of the inclination sensors relative to the shield support frame is not possible. Depending upon the quality of the mechanical basic orientation of the inclination sensors, on individual shield support frames errors can occur during the determination of the control angle as a differential between the inclination of the top canopy and the inclination of the face conveyor. To minimize such errors, pursuant to an exemplary embodiment of the invention for each individual shield support frame within a group, a control angle for the pertaining boom cylinder is determined, and from the individual control angles of the shield support frames belonging to the group, an average value is formed and a control angle that corresponds to the average value is set in the group control mechanism.

As torsion protection against overstressing of the respectively interconnected channels or chutes of the face conveyor, in the group control mechanisms of groups of shield support frames that are adjacent in the longwall equipment and are connected from a control standpoint, the control angles applicable for the adjacent groups can be compared and balanced with one another such that to avoid a mechanical overstressing of the connections of partial chute lengths of the face conveyor associated with the groups, preset maximum differences between the control angles applicable for the adjacent groups are not exceeded.

For the same reason, height differences in the position of the face conveyor existing between the groups can be used or taken into account in the comparison of the control angles applicable for adjacent groups. In this way, a maximum permissible bending radius of the conveying line of the face conveyor about the mining progression axis or advancement axis is taken into consideration.

In conformity therewith, leading or forward positions, and/or rearward or trailing positions, that exist between the groups in the exploitation direction during the progress of face conveyors and shield support frames along the longwall face, can be taken into consideration in the comparison of the control angles applicable for adjacent groups, thus taking into consideration the maximum permissible bending radius of the conveying line about the vertical axis of the longwall equipment.

To reduce or preclude a reciprocal influence of the readjustment of the control angle at individual shield support frames, or groups of shield support frames that are controlled in common, as may be required after each plow stroke, one specific embodiment of the present invention provides that the readjustment of the control angle with each plow stroke, which is controlled by the calculating unit, is effected exclusively and one time following the passage of the plow and at the end of a stepping of the shield support frames.

With regard to the arrangement of the inclination sensors that detect the position of the face conveyor, as an important parameter for the determination or checking of the control angle as a differential angle between the inclination of the top canopy of the shield support frame, and the inclination of the face conveyor in the exploitation direction, pursuant to a first specific embodiment of the present invention a central inclination sensor mounted on the face conveyor is respectively associated with a group of shield support frames coupled to one another by means of the group control mechanism; alternatively, a plurality of inclination sensors, which are disposed on individual conveying chutes of the face conveyor, are respectively arranged within a group of shield support frames that are coupled to one another by means of a boom control mechanism.

For the determination of the inclination of the face conveyor in the exploitation direction, pursuant to one exemplary embodiment of the invention one inclination sensor mounted on the face conveyor can suffice.

To improve the quality of the measurement, an inclination sensor unit mounted on the face conveyor can be embodied as a twin or double sensor that is provided with two inclination sensors having the same construction. This has the advantage that both sensors cross check the indication accuracy within a plausibility field, and if deviations occur above a tolerance range, an error signal regarding the indication accuracy can be provided; thus, a sensor drift can be ascertained. A further advantage is that if one of the sensors fails, the second sensor maintains the function, and the system can generate a trouble signal.

The accuracy of the detection of the angle can be further improved if, pursuant to one exemplary embodiment, an inclination sensor unit mounted on the face conveyor is comprised of two similar sensors that are mounted so as to have an opposite direction of rotation about the measurement axis. The arrangement of two similar sensors in the differential circuit, where the sensors have opposite directions of rotation about the measurement axis, can be utilized for compensation of (rotational) errors of the sensors caused by vibrations, and to significantly dampen the measurement value indications without losing precision. The average actual angle of the face conveyor about which the face conveyor pivots can, to a large extent, be indicated in a manner corrected for torsional vibrations, since both sensors pivot with the same frequency and amplitude, and with oppositely directed evaluation pursuant to the interference process; that signal portion that is overlapped by the vibration is compensated for, so that to a large extent the indication angle remains as when the system is at rest.

To the extent that in connection with a group control of shield support frames and pertaining boom cylinders of the boom control mechanism that is used, the hydraulic cylinders, which are connected to a hydraulic supply and control unit, are interconnected, the effect can occur that when the plow passes by, the face conveyor is pressed against the pertaining shield support frame. As a reaction to the displacement of hydraulic fluid connected therewith, the hydraulic cylinders that are disposed ahead of the plow in the direction of travel, and that belong to the same group control mechanism, can extend, whereupon undesired changes in the respective control angle can be established. To avoid such reactions, the hydraulic boom cylinders of the boom control mechanism, which are supported between the shield support frames and the face conveyor, can, after they have reached their control position, be hydraulically blocked by means of hydraulically releasable check valves that individually act upon the piston and ring surfaces of the boom cylinders, whereby the check valves are connected with the pertaining group control mechanism via associated control lines.

In connection with such individually blocked hydraulic cylinders, it can from time to time be necessary to undertake a synchronization of the boom cylinders, and for this purpose, pursuant to one proposal, all of the boom cylinders are run against an end abutment and subsequently the control angle that is required in the respective face position of the face conveyor and the plow guided thereon is set.

BRIEF DESCRIPTION OF THE DRAWINGS

Individual aspects of the present invention will subsequently be further explained with respect to the drawings, in which.

DESCRIPTION OF SPECIFIC EMBODIMENTS

Figure 1:
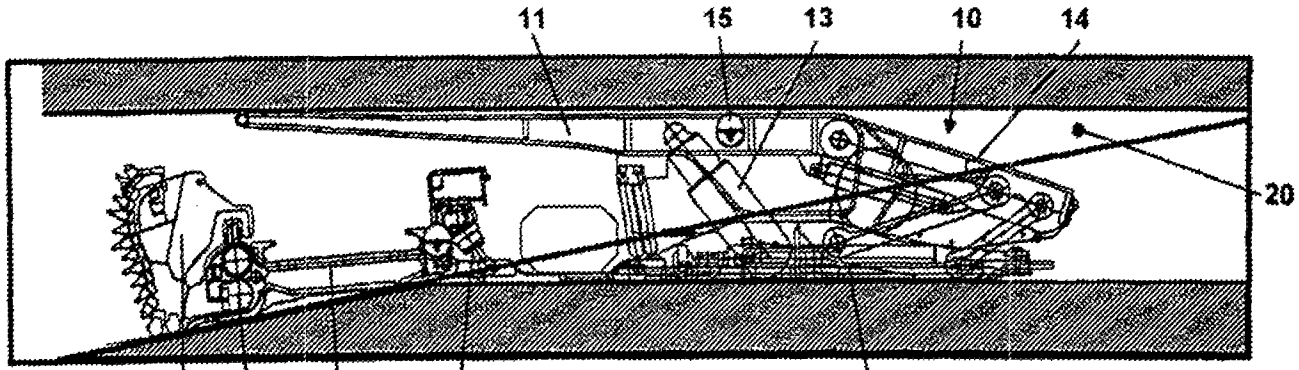
FIG. 1 is a schematic side view of longwall equipment having a control angle that prescribes a dropping motion of the plow.

The longwall equipment schematically illustrated in FIG. 1 primarily has a shield support frame 10 with a top canopy 11 and a floor skid 12; positioned between floor skid 12 and top canopy 11 are two props 13 that are disposed parallel to one another, with only one prop being recognizable in FIG. 1. Whereas the front (left) end of the top canopy 11 protrudes in the direction of the extraction machine, linked on the rear (right) of the top canopy 11 is a gob shield 14; the construction of such a shield support frame is known, so that it will not be further explained. An inclination sensor 15 is mounted at least on its top canopy 11; as not further illustrated, on the shield support frame 10, further inclination sensors are mounted on the floor skid 12 and on the gob shield 14 and/or on the support connection rods that carry the gob shield 14. With the aid of the measured values determined by the inclination sensors, the height of the shield support frame between the top canopy 11 and the floor skid 12 can be calculated.

Connected to the shield support frame 10 is a face conveyor 16 which, on its side (left) that faces the non-illustrated working face, is provided with a plow guide mechanism 18 having a plow 17 guided thereon. The face conveyor 16, with the plow 17 that is guided thereon, is pivotably disposed relative to the shield support frame 10 by means of a boom cylinder 19. In the embodiment illustrated in FIG. 1, the face conveyor 16 with plow 17 is pivoted or tipped in the direction of a dropping motion, and in particular at a control angle 20 that is set by means of the boom cylinder 19; the control angle represents a differential angle between the position of the top canopy 11 of the shield support frame 10, and the inclination of the face conveyor 16 in the exploitation direction. For this purpose, the respective inclination of the face conveyor 16 in the exploitation direction can be detected or determined via an inclination sensor 15 mounted on the face conveyor 16.

Figure 1A:
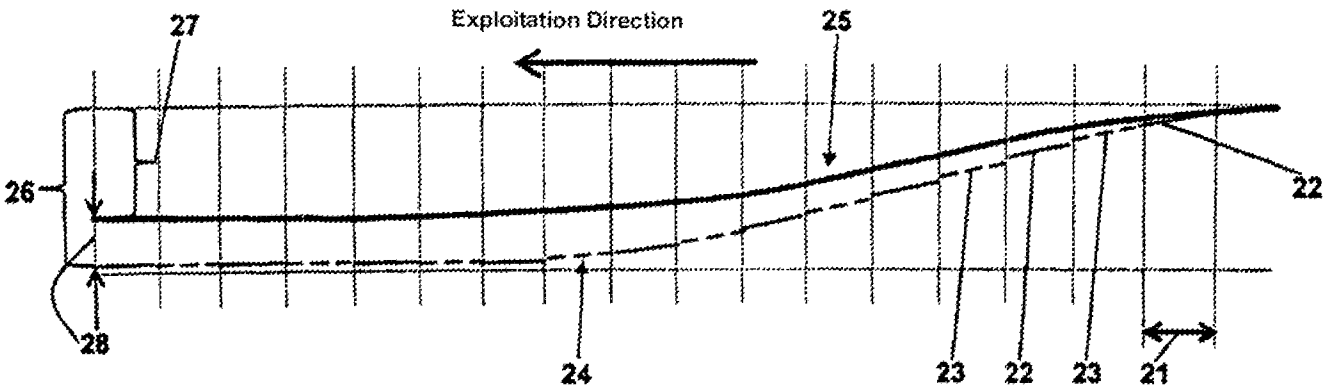
FIG. 1*a* shows the progression of the development of the height in the face using the longwall equipment of FIG. 1 during a control cycle having a plurality of plow strokes.

As can be seen from FIG. 1*a*, which illustrates 17 plow strokes in the course of one control cycle, with each plow stroke a depth of cut 21, which is assumed to be constant, is achieved, and in particular for each ascent 22 and for each descent 23. As a consequence of a control angle that in the illustrated embodiment is set to dropping motion, and that in the second half of the control cycle is prescribed as decreasing, there is determined in the associated calculating unit or computer for each plow stroke 22, 23 the anticipated projected or planned height of the longwall face, or the projected height difference that can be achieved per plow stroke respectively; this projected height or projected height difference is plotted as the curve 24 over the 17 plow strokes of the control cycle illustrated in FIG. 1*a*. The respective screening of the actually achieved actual height of the face leads to a curve course plotted as curve 25. Reference numeral 26 thus indicates the magnitude of the height differential that must be cut in order to achieve the desired target height of the face. The amount 27 corresponds to the actual freely cut height differential in the target height of the face, so that a height differential value 28 as an amount of difference between the magnitudes 26 and 27 can be determined, i.e. can be determined by the computer. To the extent, thus, that the control angle 20 is to be set for the individual ascents and descents 22, 23 of the plow, the control angle, taking into consideration the height loss between projected height and actual height by the height differential value 28, must be set that much greater that in the end the actual height increase 27 corresponds to the required height increase 26. This means that the curve 24 resulting from the control angle for the projected height is to be prescribed such that the curve 25 for the actual height ends at the magnitude of the required height differential.

If a self learning algorithm is integrated in the computer, the control or computer is in a position to learn the actual conversion of the projected height into the actual height and to utilize this for the calculation of the control strategy for the subsequent plow strokes. With newly starting up extraction operations, for this purpose, first an extraction advance of, for example, 20 m must be passed through with a manual plow level control in which the control system passively learns the control Performance for the pertaining face. Subsequently, the automatic plow level control can be put into operation, which, in the course of the further extraction advancement further learns the control performance and continuously optimizes the control strategy.

The conversion of the control angle 20 into a face height differential for setting or maintaining a target height of the face is a function of the country rock conditions, especially in the footwall, because the roof should remain as untouched as possible, since it forms the guide layer for the shield support. If the footwall is softer than the coal that is to be extracted, maintaining a target face height is very difficult, because without a guide layer, the plow must be controlled in a so to speak "floating manner" in the region of the target height. This requires frequent control interventions, since the plow conveyor system constantly moves out of the target layer, so that it must continuously be recontrolled. This unstable equilibrium during the control brings about, dictated by the process, a greatly fluctuating width of variation of the face height, resulting in risks of also cutting rock, attachment of coal, and leaving of the adjustment or control range for the support.

If the footwall is harder than the coal, the footwall layer can be utilized as a guide plane for the plow stroke, in the sense of a boundary plowing. A hard footwall means that despite a control angle that is set to dropping motion, the plow initially does not cut into the footwall, and to this extent, despite the projected height per plow stroke resulting from the setting of the control angle, no actual height alteration is obtained. The footwall so to speak reflects the control motions of the plow; therefore, the aforementioned region for the control angle can also be designated as a reflection region. With reference to the set control angle, this reflection region extends from a lower limit, which designates the boundary line for the climbing of the plow, to an upper limit, wherein when this upper limit is exceeded due to the set control angle, the plow overcomes the resistance of the footwall, cuts into the footwall, and thus carries out an effective dropping motion. Examples of these regions are illustrated in the right half of FIG. 2 by a dropping region 30, a reflection region 31 and a climbing region 32, which are controlling for the respectively applicable control angle.

Figure 2:
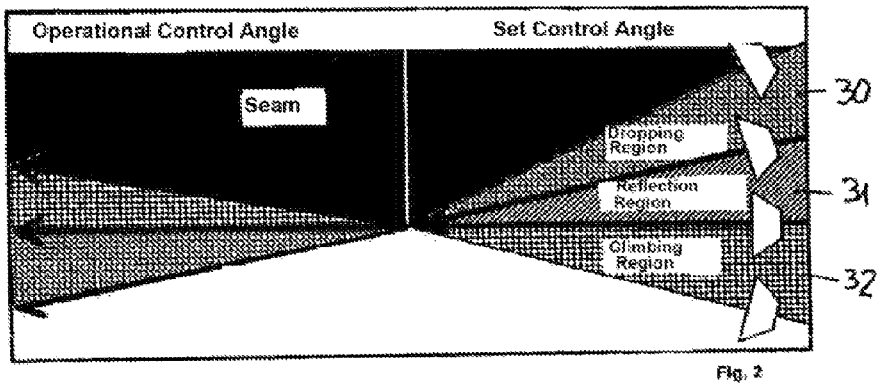
FIG. 2 is a schematic illustration showing the relationship of the control angle set at the boom control mechanism in relationship to the actually established control angle for a hard footwall having a greater hardness than does the coal.

As already indicated, the actually effective or operational control angle achieved with respect to the actual height of each plow stroke deviates from the set control angle, as is illustrated in the left half of FIG. 2. In this connection, at the operational control angle the reflection region is nearly entirely eliminated despite a control angle that is set in the reflection region, because control angles set in the reflection region here effect no actual height differential.

Figure 2A:
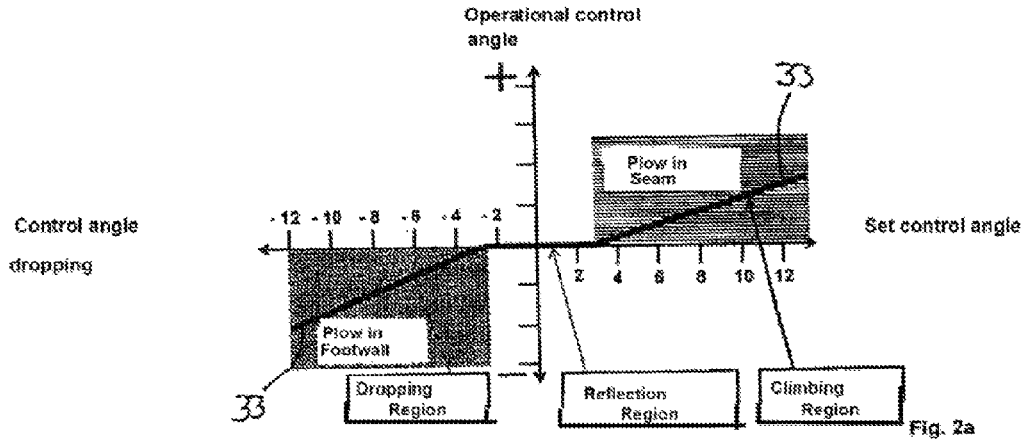
FIG. 2*a* shows the subject matter of FIG. 2 illustrated in a different manner.

The relationships in accordance therewith can be seen in FIG. 2*a* by the characteristic control curve 33 thereof. At a control angle between +3gon or angle, based on a 400° circle, and −3gon or angle, based on a 400° circle, no change of the operational control angle takes place; in this connection, when a reflection region is perceived during the plowing operation, the control strategy proceeds from setting the control angle in the middle of the reflection region by means of the control of the computer in order in particular that fluctuations during the conversion of the set control angle into the machine application have sufficient clearance without leaving the reflection region and the plow carrying out effectively undesired tilting movements.

Figure 2B:
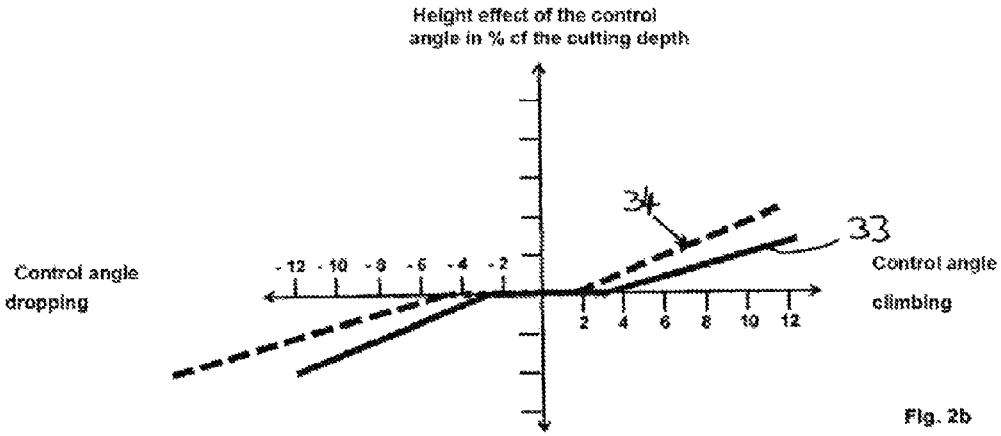
FIG. 2*b* shows the subject matter of FIG. 2 including the influence of the base chisel position.

FIG. 2*b* illustrates the relationships established in FIG. 2*a*, taking into consideration the dropping and climbing tendencies developed at the base chisel of the plow. As shown by the dashed line 34 for the characteristic control curve, this curve becomes flatter for dropping motion of the plow. The weaker the basic tendency toward dropping, developed via the base chisel of the plow, is set, then the later can an effective dropping motion be initiated. A corresponding situation exists for the climbing region. The weaker the basic tendency toward dropping developed via the base chisel, is set, the steeper the dashed characteristic control curve 34 extends in the climbing region for the climbing, and the earlier a climbing motion of the plow can be initiated.

Figure 3:
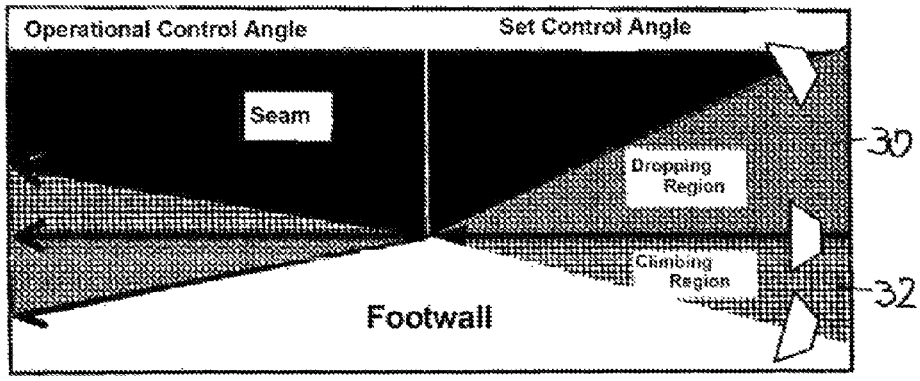
FIG. 3 shows the subject matter of FIG. 2 with a soft footwall having a lesser hardness than does the coal.
Figure 3A:
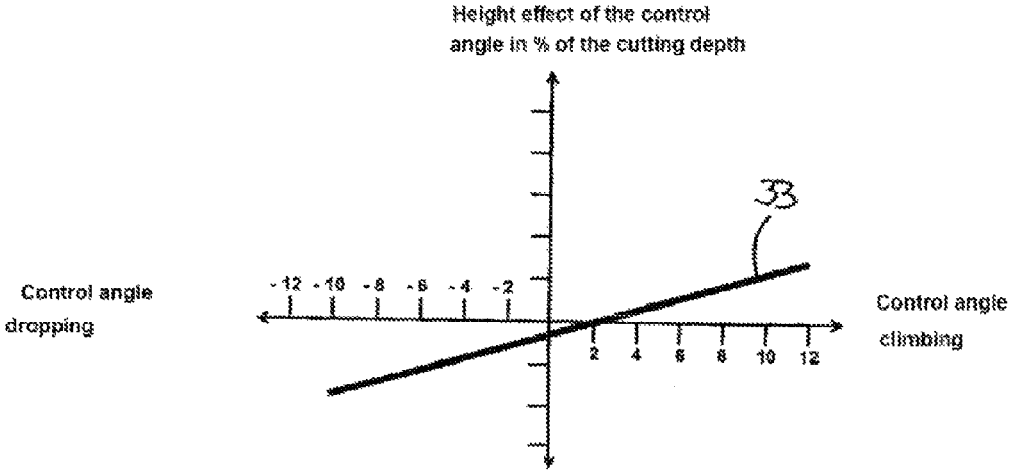
FIG. 3*a* shows the subject matter of FIG. 3 illustrated in the manner of FIG. 2*a*.

FIGS. 3 and 3*a* illustrate the relationships in conformity with FIGS. 2 and 2*a*, for the situation where the footwall is softer than the coal that is to be extracted. In this case, a guide layer formed by the footwall is not present, so that the plow immediately follows the setting of the control angle. Thus, there is no reflection region (FIG. 3), and a change between climbing of the plow and dropping of the plow takes place without passing through a transition zone (FIG. 3*a*). To the extent that this transition is illustrated in FIG. 3 at +2, a dropping tendency developed at the base chisel at the plow is manifested.

Figure 4A:
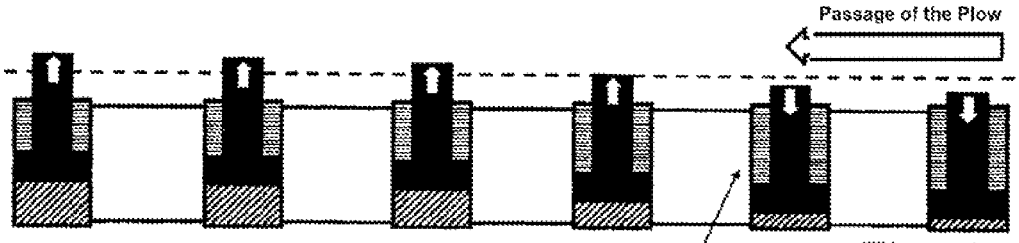
FIG. 4*a* shows the performance of the boom control mechanism within a group control mechanism without individual blocking of the boom cylinders.
Figure 4B:
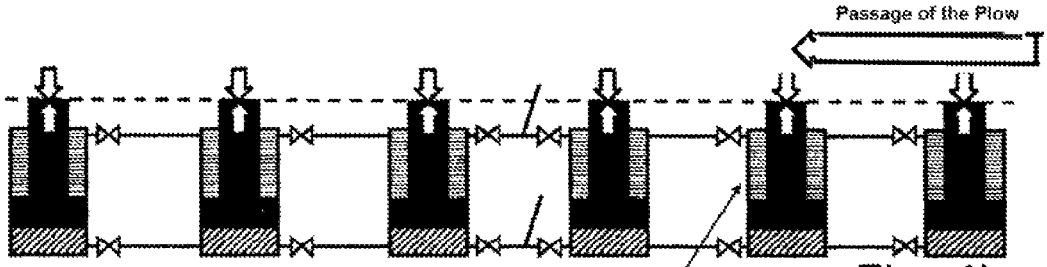
FIG. 4*b* shows the subject matter of FIG. 4*a* with individual blocking of the boom cylinders.

FIGS. 4*a*, 4*b* show the influence of the arrangement of the boom cylinders. As can be seen from FIG. 4*a*, with interconnected boom cylinders 35 the effect can occur that as the plow passes by (plow passage) the face conveyor is pressed against the pertaining shield support frame (not shown), so that hydraulic fluid is displaced out of the boom cylinders 35 disposed in the region of the plow passage. The displaced hydraulic fluid can flow to boom cylinders 35 that in the direction of travel are disposed ahead of the plow and that belong to a comparable group control; there, the hydraulic fluid provides for an extension of the boom cylinders, with which, however, there is at the same time connected a change of the control angle in this region. To avoid such reactions, the boom cylinders 35 can be respectively provided with an independent blocking or shutoff means. After reaching their control position, the boom cylinders 35 can be hydraulically blocked. As can be seen in FIG. 4*b*, the boom cylinders 35 remain unaffected by the passage of the plow.

Figure 5:
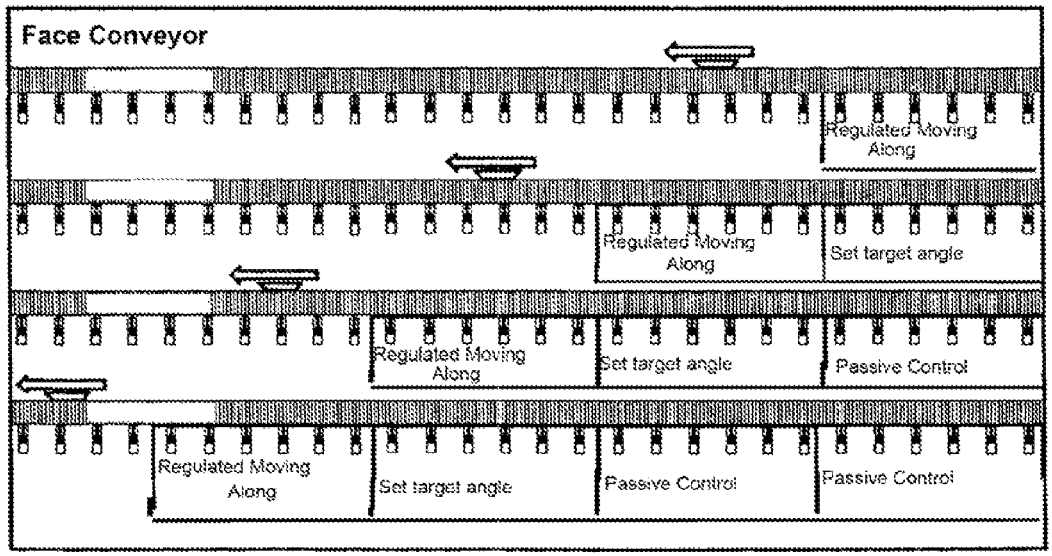
FIG. 5 is a schematic illustration of the progress of the method that is to be set with an automatic level control.

As finally shown in FIG. 5, to minimize a reciprocal effect upon adjacent control groups of shield support frames, a control sequence that follows the plow is activated; during this control sequence, the shield support, after the passage of the plow, is first moved along in a scheduled or systematic and regulated manner. After the conclusion of the moving-along process the individual control groups of the shield support frames, one after the other and sequentially, receive the control command to set the control angle for the next plow passage, and subsequently are moved along in a scheduled or systematic and regulated manner. After the conclusion of the moving-along process, the individual control groups of the shield support frames, one after the other and sequentially, receive the control command to set the control angle for the next plow passage, and subsequently to carry out no further readjustment. The possible influence of one control group is tolerated by the subsequent control group. Deviations in the control angle occurring herewith are used by the computer in the future control strategy, the control angle of which is, however, only readjusted after the next plow passage. As a consequence of such a strategy, the control shaft passes through the face following the plow. An unstable regulation due to reaction effects of adjacent control groups upon one another is reliably avoided.

The features of the subject matter disclosed in the preceding description, the patent claims, the abstract and the drawings can be important individually as well as in any desired combination with one another for realizing the various embodiments of the invention.

The specification incorporates by reference the disclosure of German 10 2008 062 381.4 filed Dec. 17, 2008, as well as International application PCT/EP2009/008863 filed Dec. 11, 2009.

The present invention is, of course, in no way restricted to the specific disclosure of the specification and drawings, but also encompasses any modifications within the scope of the appended claims.

The invention claimed is:

1. A method of setting an automatic level control of a plow (17) in longwall mining operations, in underground coal mining, equipped with a hydraulic shield support and a face conveyor (16) that guides a plow guide mechanism (18) disposed on the plow (17), including the steps of:

by means of a boom control mechanism that is supported on the shield support, changing the position of said face conveyor (16), including the plow (17) guided thereon, in exploitation;

by means of the boom control mechanism, setting a control angle (20) for setting a motion of said plow (17) in the exploitation direction as a climbing motion, dropping motion, or neutral motion;

for each stroke of said plow (17), determining a cutting depth (21) and the control angle (20), which is derived as a differential angle between an inclination of a top canopy (11) of a shield support frame (10) and an inclination of said face conveyor (16) in the exploitation direction;

in a calculating unit, calculating a face height change therefrom per plow stroke;

in the calculating unit, associating a face height, as a projected height, with each face position of said face conveyor (16), wherein the face position corresponds to a plow stroke, and wherein the projected height is then stored in the calculating unit;

when a shield support frame (10) that trails behind said plow (17) in terms of a time delay reaches a respective face position, calculating an actual height of the face on the basis of values detected by inclination sensors (15) mounted on said shield support frame (10);

comparing the calculated actual height with the stored projected height; and for subsequent plow strokes, taking into consideration a height differential value (28), between the projected height and the actual height, determined for a respective face position, in the sense of a self-learning effect of the calculating unit when the control angle (20) for said plow (17) that is to be set to achieve a projected height of the face is prescribed.

2. A method according to claim 1, which includes the further steps of predetermining, in the calculating unit, and on the basis of the control angle (20), which is to be set for achieving a target height of the face via a control cycle that includes a plurality of plow strokes, the target inclination of said face conveyor (16) in the exploitation direction, which target inclination results per plow stroke; and comparing the thus predetermined target inclination with the actual inclination of said face conveyor (16) measured in each face position per plow stroke by means of inclination sensors (15) mounted on said face conveyor (16); and if deviations are recognized, optionally correcting the control angle (20) applicable for the next plow stroke.

3. A method according to claim 1, which includes the further steps of establishing the control angle (20) respectively prescribed by the calculating unit in relationship to the height differential value (28) resulting per plow stroke; and in the calculating unit, storing the limiting control angle of a reflection region (31) determined due to the self-learning effect, wherein within such reflection region respectively applicable, even different, control angles generate no changes in the height of the face.

4. A method according to claim 3, further including, with the setting of a control angle (20) that is necessary for achieving a target height of the face, and that effects a climbing motion or a dropping movement of said plow (17), taking into account the magnitude of the respectively applicable reflection region (31); and setting the control angle (20) to a value beyond the reflection region (31) for bringing about the climbing motion or the dropping motion.

5. A method according to claim 1, wherein when the position of a base chisel of said plow (17) changes with respect to a dropping tendency, a climbing tendency or a neutral motion of said plow, the calculating unit conveys information about the changed base chisel position.

6. A method according to claim 5, wherein in the calculating unit, a performance characteristic that matches the set base chisel position, and that is acquired from a past extraction, is called up for the relationship of control angle and height differential value relative to one another.

7. A method according to claim 1, which includes the steps of determining the inclination of the top canopy (11) of the shield support frame (10) in the exploitation direction; determining from such inclination the pattern or contour of depressions and/or saddles in the exploitation direction; in the calculating unit, setting an adaptation of the path of cut of said plow (17) parallel to the contour of a roof; and, by an adaptation of the control angle (20) of the plow level control, establishing an adapted target height of the face, which includes an additional height corresponding to a radius of the depression or saddle curvature.

8. A method according to claim 1, which includes the further steps of continuing to detect the height of the shield support frame (10), not only from plow stroke to plow stroke, but also at standstill of the longwall mining operation; determining a respectively occurring convergence by means of the continuing detection of the height of the shield support frame (10); and continuously taking into account the respectively occurring convergence by an adaptation of the height differential value (28) that is to be used for setting the control angle (20) of the plow level control.

9. A method according to claim 8, which, for standstill times of the longwall mining operation, includes the further step of including a convergence that is to be expected in the determination of the height differential value (28).

10. A method according to claim 8, which, upon a raising of the floor that has occurred during a standstill of the longwall mining operation, includes the steps of detecting the change of an inclination of said face conveyor (16) during standstill of said plow (17), and, prior to beginning plowing work, recalculating the control angle (20) required for achieving the target height of the face.

11. A method according to claim 1, which includes the further step of connecting a plurality of shield support frames (10) and pertaining boom cylinders (35) of the boom control mechanism to form one group that can be controlled by means of a single group control mechanism.

12. A method according to claim 11, which includes the further steps of determining, for each individual shield support frame (10) within a group, the control angle (20) for the pertaining boom cylinder (35); and, from the individual control angles of the shield support frames (10), forming an average value and setting a control angle (20) that corresponds to the average value in the group control mechanism.

13. A method according to claim 11, which includes the further step, in the group control mechanisms of groups of shield support frames (10) that are adjacent in the longwall equipment and are connected from a control standpoint, of comparing and balancing the control angles (20) applicable for the adjacent groups with one another such that to avoid a mechanical overstressing of partial chute lengths of said face conveyor (16) associated with the groups, preset maximum differences between the control angles (20) applicable for the adjacent groups are not exceeded.

14. A method according to claim 13, which includes the further step of using or taking into account height differences in the position of the face conveyor (16) existing between the groups in the comparison of the control angles (20) applicable for adjacent groups.

15. A method according to claim 13, which, in the comparison of the control angles (20) applicable for adjacent groups, includes the further step of taking into consideration leading or forward positions and/or rearward or trailing positions that exist between the groups in the exploitation direction during the progress of face conveyors (16) and shield support frames (10) along the long wall face.

16. A method according to claim 1, which includes the step, with each plow stroke, of effecting a readjustment of the control angle (20) which is controlled by the calculating unit, exclusively and one time following the passage of said plow (17) and at the end of a stepping of the shield support frames (10).

17. A method according to one of the claim 11, which includes the further step of associating a central inclination sensor (15) mounted on said face conveyor (16) with a group of shield support frames (10) coupled to one another by means of the group control mechanism.

18. A method according to claim 11, wherein a plurality of inclination sensors, which are disposed on individual conveying chutes of said face conveyor (16), are respectively arranged within a group of shield support frames (10) that are coupled to one another by means of a boom control mechanism.

19. A method according to claim 1, which includes the further step of measuring an inclination of said face conveyor (16) by means of an inclination sensor (15) mounted on said face conveyor (16).

20. A method according to claim 1, which includes the step of mounting on said face conveyor (16) an inclination sensor unit that is embodied as a twin or double sensor provided with two inclination sensors having the same construction.

21. A method according to claim 1, which includes the further step of mounting on said face conveyor (16) an inclination sensor unit that is comprised of two similar sensors mounted so as to have an opposite direction of rotation about the measurement axis.

22. A method according to claim 1, which, after hydraulic boom cylinders (35) of the boom control mechanism, which are supported between said shield support frames (10) and said face conveyor (16), have reached their control position, includes the step of hydraulically blocking said hydraulic boom cylinders by means of hydraulically releasable check valves that are adapted to individually act upon piston and ring surfaces of said boom cylinders (35), wherein said check valves are connected with a pertaining group control mechanism via associated control lines.

23. A method according to claim 22, which includes the further steps of undertaking synchronization of said boom cylinders (35) at time intervals by running all of said boom cylinders (35) against an end abutment, and subsequently setting the control angle (20) that is required in the respective face position of said face conveyor (16) and said plow (17) that is guided thereon.

* * * * *